United States Patent [19]

Card

[11] 4,048,930

[45] Sept. 20, 1977

[54] METHOD AND APPARATUS FOR FORMING J-TUFT PILE

[75] Inventor: Roy T. Card, Chattanooga, Tenn.

[73] Assignee: Card & Co. Inc., Chattanooga, Tenn.

[21] Appl. No.: 124,829

[22] Filed: Mar. 16, 1971

[51] Int. Cl.[2] ..... D05C 15/36

[52] U.S. Cl. ..... 112/79 A

[58] Field of Search ..... 112/79 R, 79 A, 80, 112/266, 410, 221

[56] References Cited

U.S. PATENT DOCUMENTS

| | | | |
|---|---|---|---|
| 2,112,512 | 3/1938 | Windham et al. | 112/79 R |
| 2,589,340 | 3/1952 | Chambers | 112/79 R |
| 2,876,441 | 3/1959 | Boyles | 112/79 A |
| 2,990,792 | 7/1961 | Nowicki et al. | 112/79 A |
| 3,025,807 | 3/1962 | Gebert | 112/79 A |
| 3,084,645 | 4/1963 | Card | 112/79 R |
| 3,249,078 | 5/1966 | Nowicki | 112/79 R |
| 3,595,184 | 7/1971 | Watkins | 112/79 R |

*Primary Examiner*—H. Hampton Hunter

*Attorney, Agent, or Firm*—Lackey, Harrington A.

[57] ABSTRACT

The method and apparatus for stitching yarn continuously through a base fabric to initially form loops therein, cutting each loop to form a leading strand and a trailing strand, and selectively back-drawing the trailing strand after it is cut, to form J-tuft pile.

9 Claims, 11 Drawing Figures

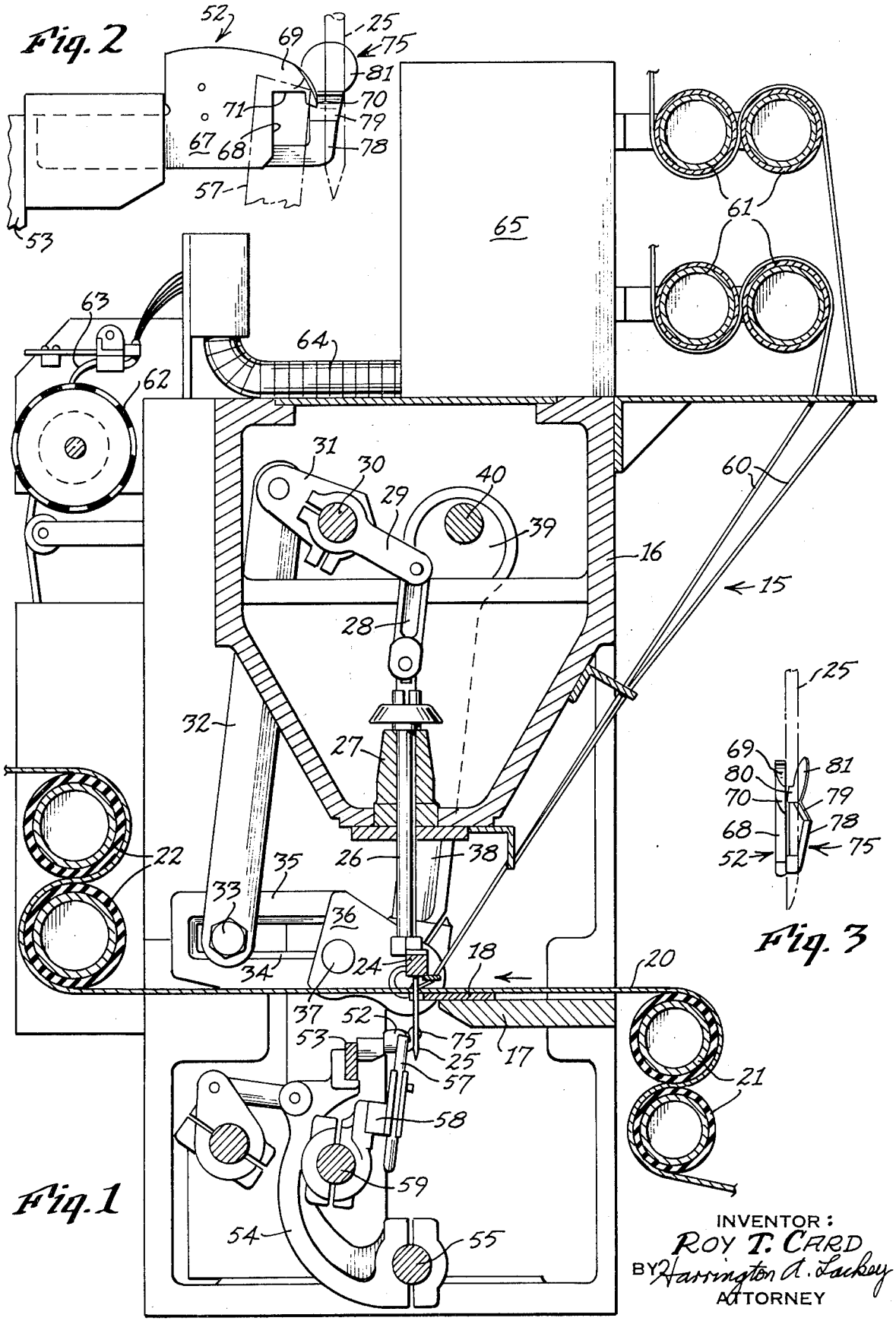
INVENTOR:
ROY T. CARD
BY Harrington A. Lackey
ATTORNEY

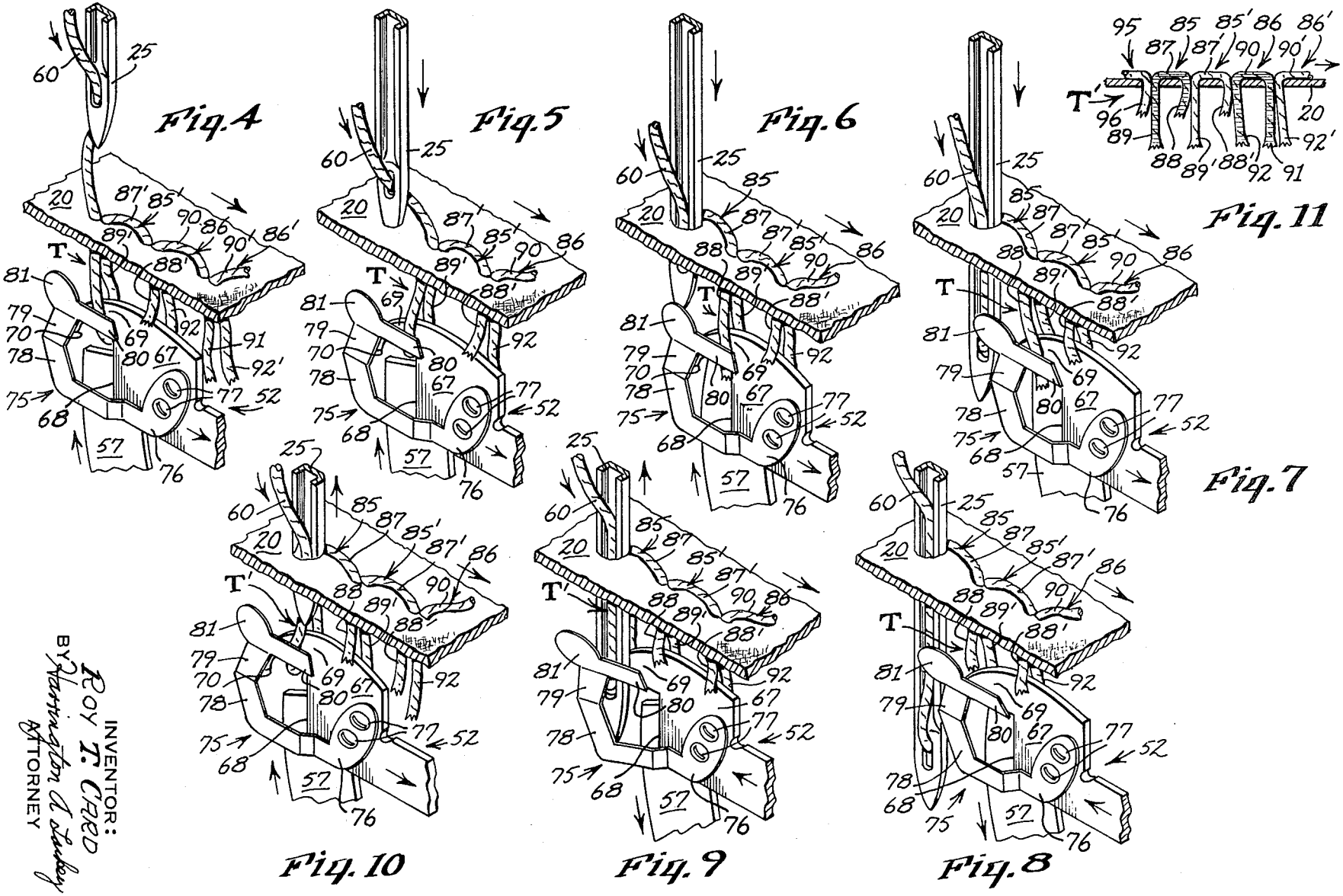
INVENTOR:
ROY T. CARD
BY Harrington A. Lackey
ATTORNEY

METHOD AND APPARATUS FOR FORMING J-TUFT PILE

BACKGROUND OF THE INVENTION

This invention relates to a method and apparatus for tufting cut pile fabrics, and more particularly to a method and apparatus for stitching J-tuft pile fabrics.

The tufting of cut pile fabrics by continuously stitching a yarn through a base fabric, forming loops of yarn upon reciprocal hooks, and then cutting the loops held upon the hooks, is well-known in the art.

The tufting of cut pile fabrics having extra long cut pile tufts, known as "shag" carpets is also known, and currently quite popular.

The art of back-robbing or back-drawing previously formed loops in a tufted loop pile fabric is well-known as disclosed in the Dykeman U.S. Pat. No. 1,831,485. Furthermore, the art of back-drawing previously formed loops in accordance with a pattern to form loop pile of different heights is also known as disclosed in the Boyles patent 2,876,441.

The Card U.S. Pat. Nos. 3,084,645; 3,138,126; and 3,075,482 disclose the use of spring clips fixed upon tufting hooks to hold loops formed on the hooks, unless sufficient tension is formed in the loops by back-drawing to pull the loops off the hooks, in order to form tufted fabrics having different pile heights. As a matter of fact, the Card U.S. Pat. No. 3,138,126 discloses an apparatus for tufting a fabric having high and low cut pile.

It has also been a common problem in the tufting industry for many years to eliminate or minimize "J-tufts" in carpeting. A J-tuft is a cut pile tuft in which the strands or legs of the cut loops are of unequal heights. Practically, most cut pile comprises J-tufts of varying degress, because the loops of yarn engaged by the tufting hook are cut by the knife on one side of the hook, rather than immediately below the hook, so that inherently a cut pile tuft is formed having unequal strand lengths or heights. Where the strands of the cut pile tuft are too unequal in height, then the appearance of the cut pile carpet is proportionately affected. Thus, where the strands or legs of the tufts are too unequal, the texture or appearance of the cut pile carpet is rough and uneven.

Accordingly, it has been the aim of the tufting industry to reduce or eliminate J-tufts from cut pile fabrics, and particularly from cut pile carpets.

SUMMARY OF THE INVENTION

It is therefore an object of this invention to produce with accentuation what the carpet industry has for years been attempting to eliminate, and that is to produce cut pile fabric, and particularly carpets having J-cut tufts with exaggerated differences in the lengths of the strands.

Another object of this invention is to produce a J-tuft cut pile in "shag" carpets.

In the method of carrying out this invention, yarns are stitched in the conventional manner in a base fabric, and loops are formed in the yarns in a conventional manner. Each loop is then cut, and subsequently, the trailing strand of yarn in each tuft is back-drawn by starving the yarn feed to the needle by any one of numerous pattern control yarn feed mechanisms, so that the trailing yarn of each cut pile tuft is substantially shorter than the leading yarn strand.

Although in conventional cut pile tufting, several loops are formed upon the reciprocal tufting hook before the leading loop is cut to form cut pile, nevertheless in this invention, only one loop is formed upon the reciprocal hook at any one time, and the loop is cut before any additional loops are received upon the hook.

Also, in a preferred form of the invention, an elastic clip or clamping member is fixed relative to the hook, and is yieldingly biased against one side of the hook, to hold the trailing yarn strand of the cut tuft in order to control the ultimate length of the back-drawn strand. The clip is also of great assistance in controlling the length of the trailing strand of a normally formed cut pile tuft which is not backdrawn.

The elastic clip is preferably provided with a cam adapted to be engaged by the needle during a portion of its downstroke to force the clip away from the hook bill as the hook bill and clip move across and on opposite sides of the needle to pick up the yarn carried by the needle to form a loop upon the hook. As the needle rises, it becomes disengaged from the cam of the clip to permit the clip to spring back against the side of the loop which will form the trailing strand of the next tuft after it is cut.

The elastic clip also functions, in the absence of back-drawing, to control the cut strands of the U-tufts to be very nearly uniform in height.

BRIEF DESCRIPTION OF THE DRAWINGS

FIG. 1 is a sectional elevation of a multiple-needle tufting machine made in accordance with this invention;

FIG. 2 is an enlarged side elevation of a tufting hook and clip made in accordance with this invention, with the needle and knife disclosed in phantom;

FIG. 3 is a front elevation of the hook and clip disclosed in FIG. 2, with the needle shown in phantom;

FIGS. 4 - 10 are enlarged fragmentary perspective views disclosing the sequential operation in forming a J-tuft stitch; and FIG. 11 is a sectional elevation disclosing J-tufts and U-tufts formed in a base fabric.

DESCRIPTION OF THE PREFERRED EMBODIMENT

Referring now to the drawings in more detail, FIG. 1 discloses a tufting machine 15 made in accordance with this invention including a frame or housing 16 having a bed-plate 17 upon which is supported a needle plate 18. The needle plate 18 is adapted to support in a substantially horizontal plane, a base fabric 20 adapted to be moved in the direction of the arrow from front to rear through the machine 15, by means such as the front fabric feed rollers 21 and the rear fabric feed rollers 22.

Extending transversely of the machine 15, that is transversely of the fabric feed, is a needle bar 24 supporting a plurality of uniformly spaced needles 25. The needle bar 24 is vertically reciprocated by any convenient means, one of which is disclosed in FIG. 1. Fixed to the top of the needle bar 24 are a plurality of push rods 26, only one of which is shown in FIG. 1, vertically reciprocal within bushings 27 in the frame 16. The upper end of each push rod 26 is pivotally connected through link arm 28 to a drive lever 29 fixed upon the rock shaft 30.

One end of the rock shaft 30 is fixed to a rock lever 31 pivotally connected to the upper end of a long link bar 32. The lower end of the link bar 32 terminates in a pin 33 adjustably journaled in an elongated slot 34 in the arm 35 of a bell crank 36 mounted upon pivot shaft 37. The opposite arm of bell crank 36 is pivotally connected to the lower end of an eccentric arm 38, the upper end of which is journaled about the rotary cam 39 fixed to the needle shaft 40. Thus, as the machine 15 is operated by virtue of the continuous rotation of the needle shaft 40, by motive means, not shown, the rock shaft 30 is continuously reciprocated to move the drive levers 29, and thereby impart vertical reciprocal motion to the needles 25 through the push rods 26 and the needle bar 24.

A looper or tufting hook 52 is provided for each needle 25, and is carried in a conventional hook bar 53 upon rocker arms 54 fixed to the reciprocal hook shaft 55.

A knife 57 for each hook 52 is mounted on knife bar 58. The knife bar 58 is fixed to the knife shaft 59 for reciprocal movement in timed relative with the hook shaft 55, by motive means, not shown, in a manner well-known in the art.

Yarns 60 are fed to the needles 25 from pairs of feed rolls 61, which are driven in any conventional manner, not shown.

The tufting machine 15 is also provided with a pattern control means, including a pattern drum 62 having pattern finger switches 63, adapted to transmit signals through electrical cable 64 to a transmission 65. The transmission may include electro-magnetic clutches adapted to change the speed of selective feed rolls 61 in accordance with the pattern on the pattern drum 62. The pattern mechanism 62 - 65 employed in the machine 15 is somewhat similar to that disclosed in U.S. Pat. No. 3,075,482 of Roy T. Card for "THREE-LEVEL TUFTED PILE APPARATUS."

It will be understood that most any type of prior-art pattern attachment may be employed in order to selectively feed the yarns 60 at different speeds to the needles 25.

As best disclosed in FIGS. 2 and 4 - 10, the tufting hook 52 made in accordance with this invention, is basically a cut pile hook mounted on the hook bar 53 so that its free end is pointing in the direction opposite from the fabric feed. The hook 52 has a rather extended, or thick, shank 67 forming an upright throat 68, but providing substantially shorter bill 69 than in a conventional cut pile hook. The free end 70 of the bill 69 turns downward in a barbed fashion, substantially typical of cut pile hoods. The bottom edge 71 of the bill 69 is just long enough to accommodate one loop at a time for cutting.

In a preferred form of the invention, the resilient clamping member or clip 75 may be fixed in any convenient position for cooperating with the tufting hook 52. As disclosed in the drawings, the clamping member 75 has a base portion 76 fixed to the shank 76 of the tufting hook 52 by any convenient means, such as bolts 77. Extending in the direction of the free end of the tufting hook 52 from the base portion 76 is an L-shaped, resilient, intermediate portion 78, which is offset laterally away from the side of the tufting hook 52. At the top of the L-shapted intermediate portion 78 is a bent angular portion 79 to the top of which is formed the finger 80 extending back along the side of the hook bill 69. The front portion of the finger 80 is enlarged and projects upward to form a cam portion 81. As disclosed in the drawings, the finger 80 and cam portion 81 may form a crease with the upper bent portion 79 and flare or diverge upward and outward from the free end of the hook 52.

With reference to FIG. 11, the cut pile formed in accordance with this invention are preferably J-tufts, 95, 85 and 85', although U-tufts 86 and 86' may also be selectively formed.

In order to clarify the definition of terms, the J-tuft 85 is a cut length of stitched yarn, including a backstitch 87 from the opposite ends of which depend a short strand 88 and a long strand 89. In a similar manner, the J-tuft 85' includes a backstitch 87', a short strand 88' and a long strand 89'. The U-tuft 86 includes a backstitch 90 and two depending long cut strands 91 and 92. A portion of a U-tuft 86' is disclosed having a backstitch 90' and a long cut strand 92'. Also, only a portion of J-tuft 95 is disclosed with a short strand 96.

In the formation of the J-tufts 95, 85 and 85', and the U-tufts 86 and 86', a continuous row of loops is stitched from a yarn 60 through the base fabric 20, and every loop is cut to form a cut pile tuft, such as T or T'. In selective cut pile tufts, one leg is shortened to form the short strands 88 and 88', and thereby form the J-tufts 85 and 85'. Thus, the loop that is stitched between the back stitches 90 and 90' is cut to form the equally long strands 91 and 92' of a uniform cut pile tuft. The loop formed between the backstitches 87' and 90 is cut to form the short leg or strand 88' and the long leg or strand 92. In a similar manner, the loop between the backstitches 87 and 87' is cut to form the short leg or strand 88 and the long leg or strand 89'.

To further clarify the nomenclature, the cut strands of each pile tuft will be differentiated as the leading strand and the trailing strand, so named in relation to the direction of fabric feed. Thus, in the pile tuft formed between the backstitches 87 and 87', the long cut strand 89' of the J-tuft 85' will be termed the leading strand of that particular cut pile tuft, while the short cut strand 88 of the J-tuft 85 will be termed the trailing strand of the particular cut pile tuft.

The U-tufts 86 and 86' are formed by feeding the yarn 60 at normal speed, while the J-tufts 95, 85 and 85' are formed by starving the yarn feed by means of the pattern control 62–65, causing the back-drawing of the trailing strand of that particular tuft, only after the loop is cut.

The operation of forming J-tuft 85 is best disclosed in the sequential operational views FIGS. 4 - 10.

In FIG. 4, the base fabric 20 is moving from front to rear, in the direction of the arrow, through the machine 15. A loop pile tuft T has just been formed on the bill 69 of the hook 52, and its trailing leg is being held against the side of the bill 69 by the resilient finger 80. The needle 25 has already reached its uppermost position and is beginning its descent for the formation of the next loop. The tufting hook 52 is withdrawing or moving rearward, while the knife 57 is moving upward toward cutting position. The pattern mechanism 62 - 65 has been energized to slow down selective yarn feed rolls 61, one pair of which controls the yarn 60 in FIG. 4, in order to starve the feed of the yarn 60 through the needle 25. In FIG. 4, the J-tuft 85' is only partially formed, that is, the short cut strand 88' has already been formed as well as the backstitch 87', but the long strand 89' has not yet been cut, and still forms the leading strand or leg of the loop pile tuft T.

FIG. 5 shows a sequence slightly later in time than that disclosed in FIG. 4, still preparatory to cutting of the loop pile tuft T.

In FIG. 6, the loop tuft T has been cut to form a cut tuft T, and in this position, the J-tuft 85' is complete, while the next J-tuft 85 is being formed. Once the tuft T has been cut, as disclosed in FIG. 6, the J-tuft 85' is set in the fabric 20, and is no longer subject to the control of the yarn feed, needle or pattern control mechanism.

After the tuft T is cut, the trailing strands 88, which is still a long strand, is held against the side of the hook 52 by the finger 80, while the needle 25 is descending through the fabric 20 and forming the backstitch 87.

At some time between the sequence positions of FIGS. 6 and 7, the point of the needle 25 engages the cam 81 to force the finger 80 away from the side of the hook 52. Thus, the resilient finger 82 releases the long cut strand 88. If the yarn feed is starved, then the needle 25 will be furnished insufficient yarn to form a normal loop at its uniform depth of penetration. Consequently, yarn would be backdrawn from the previously formed cut tuft T to shorten the trailing strand 88 to its position disclosed in FIG. 8. In FIG. 8, the needle 25 has attained its lowermost position, and the reciprocal direction of the looper 52 and knife 57 have reversed, that is, the looper 52 is now moving forward toward the needle 25, while the knife 57 is moving down to open the throat 68 of the looper 52 in order to receive the next loop upon the bill 69.

As the tufting hook 52 continues to move forward, the clamping member 75 also moves forward with the hook 52. The forwardly moving cam member 81 is thus thrust laterally away from the bill 69 by the needle 25, permitting the needle 25 to move between the finger 80 and the bill 69, as best disclosed in FIG. 9. Simultaneously, the bill 69 is crossing the needle 25 in a conventional manner to pick up the next loop tuft T'. The needle 25 then moves upward leaving the loop tuft T' upon the hook bill 69, the disengaging the clamping finger 80 to spring back in holding engagement against the trailing leg of the loop tuft T', as best disclosed in FIG. 10. In FIG. 10, the movement of the hook 52 and knife 57 is against reversed to initiate the next cutting operation upon the loop tuft T'. The needle 25 continues upward until it reaches the apex of its upstroke, when the cycle is repeated.

It is thus seen that a very unique cut pile stitch has been developed in which a J-tuft having a pronounced difference in the depths of its legs or strands is developed by backdrawing the cut yarn strand depending from the previously formed backstitch, only after the previously formed loop has been cut. By cutting every loop in a line of stitching immediately after it is formed, and prior to the formation of the next subsequent loop, and selectively backdrawing each cut strand through the immediately formed backstitch, a cut pile fabric of unusually pleasing appearance has been produced.

Considerable control over the backdrawing of the cut strand, and consequently of the length of the cut strand is developed by the employment of the resilient clamping member 75. The clamping member 75 is also extremely effective in the control of the length of the strands or legs of the U-tufts 86 and 86', as well as the J-tufts 85 and 85'.

It will be understood that the yarn clamping member 75 may be fixed to any other part which moves with the tufting hook 52, such as the hook bar 53, so long as the clamping finger 80 is maintained in its operative position against the side of the hook bill 69 in order to yieldingly hold the trailing leg of the loop against the hook 52, and in order to carry out the above described functions.

As previously mentioned, the hook 52 is provided with a relatively short bill 69. The reciprocal movement of the short bill 69 and the movement of the knife 57 are controlled so that only one loop at a time may be received and cut by the hook bill 69. If several loops are collected on the looper bill 69, as is customary in conventional cut pile tufting, before a loop adjacent the throat 68 is cut, then the backdrawing will be ineffective to pull the cut trailing strand in order to shorten it and form a J-tuft. In the conventional cut pile formation, only the immediately formed loop would be backdrawn. Of course, it is possible that accidentally, the cut strand might be shortened by drawing the yarn back through all the intermediate loops and backstitches, but such action would be fortuitous and would produce, if at all, short backdrawn strands of varying heights or depths.

The method and machine 15 incorporating this invention have been very effectively used for the production of J-tufts in shag carpets in which the long cut strands are much longer than in conventional cut pile carpets, and also much longer than the short cut strands.

By constructing the finger 80 to converge downward against the side of the bill 69, a more effective clamping or gripping surface is formed by the bottom edge of the finger 80 against the upward movement of the clamped cut strand. Although the entire clamping member 75 is preferably made of elastic or reislient material, nevertheless most of the elasticity is obtained in the intermediate L-shaped portion 78. The elasticity of the clamping member 75 is sufficient to hold the clamped strand, yet sufficiently yielding to permit the strand to remove itself from its clamped position when the tension in the backdrawn cut strand has attained a predetermined value.

The clamping member 75 is also functional to hold the cut strand, such as 88 upon the upstroke of the needle 25, as well as on the downstroke. In other words, the clamping finger 80 will hold the strand against possible backdrawing caused by the needle 25 along as it causes the yarn carried by the needle 25 to frictionally engage the hole punched by the needle in the web 20. Such friction will vary with the type of base fabric material 20.

FIG. 11 discloses a continuous line of stitching in which the U-tufts 86 and 86' and the J-tufts 95, 85 and 85' have been completed and at a time subsequent to the position disclosed in FIG. 10, after the loop tuft T' has been cut and its trailing strand backdrawn.

It will be understood that the bill 69 of the hook 52 may be longer, provided only one loop at a time is received on the bill and cut. For example, a knife 57 having a longer cutting edge could be cooperatively employed with a longer hook bill 69.

What is claimed is:

1. A machine for forming J-tuft cut pile comprising:
   a. means supporting a base fabric,
   b. means for stitching a yarn continuously through said base fabric to form substantially uniformly spaced loops therein,
   c. a hook having a free end to enter each loop, and a closed end,
   d. means for relatively moving each loop upon said hook toward its closed end, e. means cooperating with said hook to cut each loop on said hook, to form a leading strand of predetermined pile height and a trailing strand, f. backdrawing means cooperative with said stitching means for positively backdrawing said trailing strand, only after said loop is cut, a limited distance less than said pile height, to form said trailing strand within and projecting from the same side of said base fabric as said leading strand to a height substantially less than said pile height, g. a resilient clamping member, and h. mounting means fixing said clamping member relative to said hook and biasing said clamping member toward engagement with said hook, to permit movement of said loop upon said hook and to yieldingly hold said trailing strand on said hook, in order to control the uniform length of each trailing strand.

2. The invention according to claim 1 in which said stitching means comprises a needle, means for continuously reciprocably moving said needle through said fabric to a depth equal to said pile height on one side of said hook, and means mounting said cooperating means to cut each loop on the opposite side of said hook from said needle.

3. The invention according to claim 2 in which said clamping member comprises an elastic clip biased toward engagement with the same side of said hook as said needle for resiliently clamping said cut trailing strand against said hook.

4. The invention according to claim 3 in which said clip further comprises a cam portion for engagement by said needle during a portion of its down-stroke, to separate said clip from said hook as said needle moves with said loop relatively toward the closed end of said hook.

5. The invention according to claim 1 further comprising means for selectively actuating said backdrawing means to produce a patterned tufted cut pile fabric including J-tufts and U-tufts.

6. The invention according to claim 1 in which said backdrawing means comprises yarn feed means for supplying yarn to said stitching means inadequate to form a normal loop of said predetermined pile height upon said hook.

7. The invention according to claim 1 in which said cooperating means comprises a knife having a cutting edge whose length is substantially equal to the distance between the free end and the closed end of said hook, and means for relatively moving said knife and said hook toward each other, so that said cutting edge cooperates substantially coextensively with said hook to cut every loop upon said hook.

8. In a tufting apparatus for producing cut pile fabric having reciprocable needle means including a needle, and looper means including a looper having a bill, and a knife, said needle cooperating with one side of said looper to form a loop on said looper, said knife cooperating with the other side of said looper to cut a loop on said looper, a clamping member, mounting means fixing said clamping member relative to said looper and on the same side of said looper as said needle, said clamping member being resilient and having a retaining portion thereof disposed in close juxtaposition with a yarn-carrying portion of said looper bill for clamping one leg of a cut loop between the retaining portion of said clamping member and said looper bill.

9. The invention according to claim 8 in which said knife has a cutting edge substantially as long as said bill, and means for relatively moving said knife and said looper towrd each other so that said cutting edge cooperates substantially coextensively with said bill to cut every loop upon said bill.

* * * * *